US008333485B2

(12) United States Patent
Waters

(10) Patent No.: US 8,333,485 B2
(45) **Date of Patent: *Dec. 18, 2012**

(54) HEADWEAR WITH SWITCH SHIELDING PORTION

(76) Inventor: Michael Waters, Aspen, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/829,786

(22) Filed: Jul. 2, 2010

(65) Prior Publication Data

US 2010/0307931 A1 Dec. 9, 2010

Related U.S. Application Data

(60) Division of application No. 12/363,130, filed on Jan. 30, 2009, now Pat. No. 7,753,547, which is a continuation of application No. PCT/US2008/087542, filed on Dec. 18, 2008.

(60) Provisional application No. 61/014,726, filed on Dec. 18, 2007.

(51) Int. Cl.
*F21V 21/084* (2006.01)

(52) U.S. Cl. ..... 362/106; 362/105; 362/376; 2/209.13; 200/304; 206/8

(58) Field of Classification Search ..... 2/175.1, 2/181, 209.13; 200/304; 206/8; 362/105, 362/106, 376; 40/329
See application file for complete search history.

(56) References Cited

U.S. PATENT DOCUMENTS

| | | | |
|---|---|---|---|
| 1,109,415 | A | 9/1914 | Harris |
| 1,255,265 | A | 2/1918 | Zachara |
| 1,572,210 | A | 2/1926 | Kolibas |
| 1,744,777 | A | 1/1930 | Lundgren |
| 1,749,998 | A | 3/1930 | Collins |
| D137,375 | S | 2/1944 | Heit |
| 2,369,829 | A | 2/1945 | Johnson |
| 2,461,254 | A | 2/1949 | Bassett |
| 2,473,394 | A | 6/1949 | Scott |
| 2,638,532 | A | 5/1953 | Brady |
| 2,640,980 | A | 6/1953 | Prupis |
| 2,705,751 | A | 4/1955 | Harris et al. |
| 2,788,439 | A | 4/1957 | Hesse |
| 2,904,670 | A | 9/1959 | Calmes |
| 2,978,696 | A | 4/1961 | Keller et al. |

(Continued)

FOREIGN PATENT DOCUMENTS

| | | |
|---|---|---|
| AU | 11785/76 | 9/1977 |

(Continued)

OTHER PUBLICATIONS

Docket report of *Waters Industries, Inc.* v. *Totes Isotoner Corporation*, et al., United States District Court for the Northern District of Illinois, Case No. 1:10-cv-04487 filed Jul. 19, 2010.

(Continued)

*Primary Examiner* — Stephen F Husar
(74) *Attorney, Agent, or Firm* — Fitch Even Tabin & Flannery, LLP

(57) ABSTRACT

There is provided hands-free lighting, components thereof, and other accessories combined with the hands-free lighting. The hands-free lighting is preferably lighted headgear including hats and includes various accessories for use therewith, such as a protective switch guard associated with hat packaging surrounding an activation switch to prevent inadvertent activation while still allowing intentional actuation thereof.

28 Claims, 4 Drawing Sheets

U.S. PATENT DOCUMENTS

| | | | |
|---|---|---|---|
| 3,008,040 | A | 11/1961 | Moore |
| 3,032,647 | A | 5/1962 | Wansky et al. |
| 3,040,881 | A | 6/1962 | McNeil |
| 3,060,308 | A | 10/1962 | Fortuna |
| 3,123,208 | A | 3/1964 | Barnum et al. |
| 3,184,058 | A | 5/1965 | Crowther |
| 3,201,771 | A | 8/1965 | Proulx |
| 3,350,552 | A | 10/1967 | Lawrence |
| 3,358,137 | A | 12/1967 | Sinclair et al. |
| 3,491,374 | A | 1/1970 | Frangos |
| 3,537,909 | A | 11/1970 | Horton |
| 3,602,759 | A | 8/1971 | Evans et al. |
| 3,666,901 | A | 5/1972 | Weinhart |
| 3,749,902 | A | 7/1973 | Drew |
| 3,845,389 | A | 10/1974 | Phillips et al. |
| 3,947,676 | A | 3/1976 | Battilana et al. |
| 3,963,917 | A | 6/1976 | Romano |
| 4,005,776 | A | 2/1977 | Seeley |
| 4,011,600 | A | 3/1977 | Malk |
| 4,053,688 | A | 10/1977 | Perkins et al. |
| 4,186,429 | A | 1/1980 | Johnston |
| 4,210,952 | A | 7/1980 | Ressmeyer |
| 4,231,079 | A | 10/1980 | Heminover |
| 4,283,127 | A | 8/1981 | Rosenwinkel et al. |
| 4,298,913 | A | 11/1981 | Lozar |
| 4,364,107 | A | 12/1982 | Wieczorek et al. |
| 4,406,040 | A | 9/1983 | Cannone |
| D272,733 | S | 2/1984 | Cosmos et al. |
| 4,462,064 | A | 7/1984 | Schweitzer |
| 4,470,263 | A | 9/1984 | Lehovec et al. |
| 4,483,021 | A | 11/1984 | McCall |
| 4,516,157 | A | 5/1985 | Campbell |
| 4,521,831 | A | 6/1985 | Thayer |
| 4,541,698 | A | 9/1985 | Lerner |
| 4,551,857 | A | 11/1985 | Galvin |
| 4,559,516 | A | 12/1985 | Schott et al. |
| 4,570,206 | A | 2/1986 | Deutsch |
| 4,602,191 | A | 7/1986 | Davila |
| 4,604,760 | A | 8/1986 | Coin |
| 4,638,410 | A | 1/1987 | Barker |
| 4,642,817 | A | 2/1987 | Ferstenfeld |
| 4,665,568 | A | 5/1987 | Stutes |
| 4,669,610 | A | 6/1987 | Lindsey et al. |
| 4,680,815 | A | 7/1987 | Hirsch et al. |
| 4,794,496 | A | 12/1988 | Lanes et al. |
| 4,817,212 | A | 4/1989 | Benoit |
| 4,827,384 | A | 5/1989 | Von Schlemmer |
| 4,872,218 | A | 10/1989 | Holt |
| 4,901,210 | A | 2/1990 | Hanabusa |
| 4,901,211 | A | 2/1990 | Shen |
| 4,945,458 | A | 7/1990 | Batts et al. |
| 4,959,760 | A | 9/1990 | Wu |
| 4,963,045 | A | 10/1990 | Willcox |
| 4,991,068 | A | 2/1991 | Mickey |
| 4,998,187 | A | 3/1991 | Herrick |
| D316,932 | S | 5/1991 | Escher, Jr. |
| 5,039,829 | A | 8/1991 | Brucksch |
| 5,060,814 | A | 10/1991 | Oglesbee |
| 5,068,771 | A | 11/1991 | Savage, Jr. |
| 5,070,436 | A | 12/1991 | Alexander et al. |
| 5,088,127 | A | 2/1992 | Thornock |
| 5,111,366 | A | 5/1992 | Rife et al. |
| 5,113,325 | A | 5/1992 | Eisenbraun |
| 5,122,943 | A | 6/1992 | Pugh |
| 5,140,116 | A | 8/1992 | Schmitt-Walter |
| 5,140,220 | A | 8/1992 | Hasegawa |
| 5,143,443 | A | 9/1992 | Madsen |
| 5,163,420 | A | 11/1992 | Van Der Bel |
| 5,165,789 | A | 11/1992 | Womack |
| 5,189,512 | A | 2/1993 | Cameron et al. |
| 5,193,220 | A | 3/1993 | Ichinohe et al. |
| 5,193,347 | A | 3/1993 | Apisdorf |
| 5,218,385 | A | 6/1993 | Lii |
| 5,224,772 | A | 7/1993 | Fustos |
| 5,230,558 | A | 7/1993 | Jong |
| 5,245,516 | A | 9/1993 | de Haas et al. |
| 5,249,675 | A | 10/1993 | Strauss et al. |
| 5,278,734 | A | 1/1994 | Ferber |
| D349,123 | S | 7/1994 | Cooley et al. |
| 5,329,637 | A | 7/1994 | Walker |
| 5,331,333 | A | 7/1994 | Tagawa et al. |
| 5,331,357 | A | 7/1994 | Cooley et al. |
| 5,357,409 | A | 10/1994 | Glatt |
| 5,363,291 | A | 11/1994 | Steiner |
| 5,404,593 | A | 4/1995 | Kronenberger |
| 5,408,393 | A | 4/1995 | Becker |
| 5,410,746 | A | 4/1995 | Gelber |
| 5,412,545 | A | 5/1995 | Rising |
| 5,423,419 | A | 6/1995 | Wentz et al. |
| 5,438,698 | A | 8/1995 | Burton et al. |
| 5,452,190 | A | 9/1995 | Priesemuth |
| 5,460,346 | A | 10/1995 | Hirsch |
| 5,463,538 | A | 10/1995 | Womack |
| 5,467,992 | A | 11/1995 | Harkness |
| 5,485,358 | A | 1/1996 | Chien |
| 5,503,637 | A | 4/1996 | Kyricos et al. |
| 5,508,900 | A | 4/1996 | Norman |
| 5,510,961 | A | 4/1996 | Peng |
| 5,541,767 | A | 7/1996 | Murphy et al. |
| 5,541,816 | A | 7/1996 | Miserendino |
| 5,542,627 | A | 8/1996 | Crenshaw et al. |
| 5,546,099 | A | 8/1996 | Quint et al. |
| 5,564,128 | A | 10/1996 | Richardson |
| 5,567,038 | A | 10/1996 | Lary |
| 5,575,554 | A | 11/1996 | Guritz |
| 5,610,678 | A | 3/1997 | Tsuboi et al. |
| 5,644,189 | A | 7/1997 | Busby |
| 5,655,374 | A | 8/1997 | Santilli |
| 5,667,291 | A | 9/1997 | Caplan et al. |
| 5,667,292 | A | 9/1997 | Sabalvaro, Jr. |
| 5,676,449 | A | 10/1997 | Newsome |
| 5,677,079 | A | 10/1997 | DeZorzi |
| 5,680,718 | A | 10/1997 | Ratcliffe et al. |
| 5,688,039 | A | 11/1997 | Johnson |
| 5,692,244 | A | 12/1997 | Johnson et al. |
| 5,708,449 | A | 1/1998 | Heacock et al. |
| 5,718,335 | A | 2/1998 | Boudreaux |
| 5,722,762 | A | 3/1998 | Soll |
| 5,730,290 | A | 3/1998 | Futo |
| 5,741,060 | A | 4/1998 | Johnson |
| 5,743,621 | A | 4/1998 | Mantha et al. |
| 5,758,947 | A | 6/1998 | Glatt |
| 5,786,665 | A | 7/1998 | Ohtsuki et al. |
| 5,800,278 | A | 9/1998 | Varriano |
| 5,822,636 | A | 10/1998 | Cho |
| 5,829,063 | A | 11/1998 | Cheng |
| 5,836,673 | A | 11/1998 | Lo |
| 5,845,778 | A | 12/1998 | Hickey, Jr. |
| 5,845,987 | A | 12/1998 | Painter |
| 5,857,220 | A | 1/1999 | Erny et al. |
| 5,865,333 | A | 2/1999 | Wolfe |
| 5,871,271 | A | 2/1999 | Chien |
| D407,187 | S | 3/1999 | Makki |
| 5,876,241 | A | 3/1999 | Frantz |
| 5,894,604 | A | 4/1999 | Crabb et al. |
| 5,918,966 | A | 7/1999 | Arnold |
| 5,920,910 | A | 7/1999 | Calvo |
| 5,921,674 | A | 7/1999 | Koczi |
| 5,922,489 | A | 7/1999 | Adachi |
| 5,931,693 | A | 8/1999 | Yamazaki |
| 5,946,071 | A | 8/1999 | Feldman |
| 5,982,969 | A | 11/1999 | Sugiyama et al. |
| 5,997,165 | A | 12/1999 | Lehrer |
| 6,005,536 | A | 12/1999 | Beadles et al. |
| 6,007,212 | A | 12/1999 | Chan |
| 6,007,213 | A | 12/1999 | Baumgartner |
| 6,009,563 | A | 1/2000 | Swanson et al. |
| 6,012,822 | A | 1/2000 | Robinson |
| 6,012,827 | A | 1/2000 | Caplan et al. |
| 6,021,525 | A | 2/2000 | Mertins |
| 6,023,788 | A | 2/2000 | McCallum et al. |
| 6,028,627 | A | 2/2000 | Helmsderfer |
| 6,032,291 | A | 3/2000 | Asenguah et al. |
| 6,032,293 | A | 3/2000 | Makki |
| 6,056,413 | A | 5/2000 | Urso |
| D428,431 | S | 7/2000 | Jordan |
| 6,086,214 | A | 7/2000 | Ridge |

6,087,037 A 7/2000 Rieder
6,088,053 A 7/2000 Hammack et al.
6,094,749 A 8/2000 Proctor
6,113,243 A 9/2000 Saul
6,113,244 A 9/2000 Baumgartner
6,116,745 A 9/2000 Yei
6,124,056 A 9/2000 Kimura
6,126,294 A 10/2000 Koyama et al.
6,167,570 B1 1/2001 Su
6,168,286 B1 1/2001 Duffy
6,172,657 B1 1/2001 Kamakura et al.
6,174,075 B1 1/2001 Fuwausa
6,206,543 B1 3/2001 Henry
6,237,147 B1 5/2001 Brockman
6,240,566 B1 6/2001 Scantlin
6,244,721 B1 6/2001 Rodriguez et al.
6,250,769 B1 6/2001 Kirk
6,256,795 B1 7/2001 Habel
6,290,368 B1 9/2001 Lehrer
6,306,538 B1 10/2001 Saitoh et al.
6,307,526 B1 10/2001 Mann
6,311,837 B1 11/2001 Blaustein et al.
6,320,822 B1 11/2001 Okeya et al.
6,325,521 B1 12/2001 Gregg et al.
6,328,454 B1 12/2001 Davis
6,340,234 B1 1/2002 Brown, Jr.
6,345,716 B1 2/2002 Chapman
6,347,410 B1 2/2002 Lee
6,363,537 B1 4/2002 Park
6,382,407 B1 5/2002 Chao
6,386,701 B1 5/2002 Khulusi
6,390,640 B1 5/2002 Wong et al.
6,398,386 B1 6/2002 Huang
6,416,199 B1 7/2002 Heine
6,431,904 B1 8/2002 Berelsman
6,442,764 B1 9/2002 Badillo et al.
6,457,838 B1 10/2002 Dugmore et al.
6,461,015 B1 10/2002 Welch
6,461,025 B1 10/2002 Payne
6,474,830 B1 11/2002 Hansen
6,497,493 B1 12/2002 Theisen
6,504,099 B2 1/2003 Huang
6,549,231 B1 4/2003 Matsui
6,553,570 B1 4/2003 Flynn
6,578,982 B1 6/2003 Lynch
6,598,991 B2 7/2003 Altman
6,604,837 B2 8/2003 Sandberg
6,616,293 B2 9/2003 Mickey
6,659,618 B2 12/2003 Waters
6,679,615 B2 1/2004 Spearing
6,704,044 B1 3/2004 Foster et al.
6,709,142 B2 3/2004 Gyori
6,713,956 B2 3/2004 Chen et al.
6,715,309 B1 4/2004 Junkins
6,719,437 B2 4/2004 Lary et al.
6,721,962 B1 4/2004 Polaire
D489,165 S 5/2004 Waters
6,733,150 B1 5/2004 Hanley
6,760,925 B1 7/2004 Maxwell
6,802,636 B1 10/2004 Bailey, Jr.
6,811,441 B2 11/2004 Simpson
6,830,357 B2 12/2004 Lopez
6,837,590 B2 1/2005 Marston
6,860,628 B2 3/2005 Robertson et al.
6,865,285 B1 3/2005 Villa-Aleman
6,908,208 B1 6/2005 Hyde et al.
6,923,322 B2 8/2005 Lenker
6,932,216 B2 8/2005 Blaustein et al.
6,935,761 B2 8/2005 Vanderschuit
6,941,583 B2 9/2005 Yan
6,966,668 B2 11/2005 Cugini et al.
6,969,178 B2 11/2005 Zuloff
6,977,776 B2 12/2005 Volkenandt et al.
6,993,803 B2 2/2006 Chan
6,994,445 B1 2/2006 Pomes
7,000,841 B2 2/2006 Becker
7,003,353 B1 2/2006 Parkhouse
7,004,439 B1 2/2006 Taylor et al.
7,021,790 B2 4/2006 Parsons
D520,460 S 5/2006 Wadsworth et al.
7,052,154 B2 5/2006 Vanderschuit
7,086,749 B1 8/2006 Hanley
7,094,981 B2 8/2006 Sorrentino et al.
7,105,939 B2 9/2006 Bednyak
7,111,956 B2 9/2006 Brown
7,118,241 B2 10/2006 Sohn
7,118,262 B2 10/2006 Negley
7,128,434 B1 10/2006 Nally et al.
7,147,338 B2 12/2006 Gregg
7,163,309 B2 1/2007 Sohn
7,182,478 B2 2/2007 Marston
7,186,159 B1 3/2007 Baxter
7,192,151 B2 3/2007 Clupper et al.
7,234,831 B1 6/2007 Hanley
D566,044 S 4/2008 D'Arco et al.
7,369,174 B2 5/2008 Olita et al.
7,427,149 B2 9/2008 Sohn
7,431,472 B2 10/2008 Becker
7,461,764 B2 12/2008 Thompson
7,470,022 B2 12/2008 Lerner
7,506,992 B2 3/2009 Carter
D591,675 S 5/2009 Waters
7,576,800 B2 8/2009 Swain
D600,208 S 9/2009 Waters
7,609,295 B2 10/2009 Aridome et al.
7,611,255 B1 11/2009 Lagassey
7,621,000 B1 * 11/2009 Fulton ..... 2/209.13
7,661,818 B2 2/2010 Waters
7,677,751 B2 3/2010 Kinsman et al.
7,753,547 B2 7/2010 Waters
7,784,960 B2 8/2010 Lahtinen
2001/0024365 A1 9/2001 Aknine
2002/0131275 A1 9/2002 Yamamoto et al.
2002/0159250 A1 10/2002 Kuo et al.
2002/0163800 A1 11/2002 Hansen
2002/0186557 A1 12/2002 Lary et al.
2002/0187806 A1 12/2002 Jang
2003/0079387 A1 5/2003 Derose
2003/0106918 A1 6/2003 Hung
2003/0151910 A1 8/2003 Marston
2003/0169207 A1 9/2003 Beigel
2003/0231489 A1 12/2003 Hsiao
2004/0141312 A1 7/2004 Henning et al.
2004/0165109 A1 8/2004 Lee
2004/0222638 A1 11/2004 Bednyak
2004/0240067 A1 12/2004 Marusi et al.
2004/0240204 A1 12/2004 Russ et al.
2004/0264176 A1 12/2004 Vanderschuit
2005/0001433 A1 1/2005 Seelin
2005/0047116 A1 3/2005 Gagne
2005/0066422 A1 3/2005 Yan
2005/0072458 A1 4/2005 Goldstein
2005/0078473 A1 4/2005 Zuloff
2005/0083676 A1 4/2005 VanderSchuit
2005/0099799 A1 5/2005 Cugini et al.
2005/0105285 A1 5/2005 Maden
2005/0161313 A1 7/2005 Sorrentino et al.
2005/0174753 A1 8/2005 Cao et al.
2005/0204490 A1 9/2005 Kemp et al.
2005/0211187 A1 9/2005 Harman et al.
2005/0211574 A1 9/2005 Reeve
2005/0219837 A1 10/2005 Brown
2005/0265015 A1 12/2005 Salazar
2006/0037125 A1 2/2006 McDowell
2006/0091784 A1 5/2006 Conner et al.
2006/0092621 A1 5/2006 Lai
2006/0107952 A1 5/2006 Schlosser
2006/0125624 A1 6/2006 Ostrovsky et al.
2006/0126323 A1 6/2006 Pomes
2006/0138440 A1 6/2006 Jyo
2006/0141828 A1 6/2006 Dean et al.
2006/0157569 A1 7/2006 Becker
2006/0158895 A1 7/2006 Brands et al.
2006/0165160 A1 7/2006 Winningstad et al.
2006/0198122 A1 9/2006 Senter et al.
2006/0215393 A1 9/2006 VanderSchuit
2006/0232955 A1 10/2006 Labine
2006/0239018 A1 10/2006 Jardin

| | | | |
|---|---|---|---|
| 2006/0263677 | A1 | 11/2006 | Tsai |
| 2006/0285315 | A1 | 12/2006 | Tufenkjian |
| 2006/0286443 | A1 | 12/2006 | Huang |
| 2006/0291193 | A1 | 12/2006 | Hill |
| 2007/0003826 | A1 | 1/2007 | Hsu |
| 2007/0048598 | A1 | 3/2007 | Huang |
| 2007/0053179 | A1 | 3/2007 | Pang et al. |
| 2007/0058361 | A1 | 3/2007 | Sevilla |
| 2007/0064413 | A1 | 3/2007 | Slater |
| 2007/0072655 | A1 | 3/2007 | Cascone |
| 2007/0074752 | A1 | 4/2007 | Shau et al. |
| 2007/0097668 | A1 | 5/2007 | Choi |
| 2007/0140675 | A1 | 6/2007 | Yanagi |
| 2007/0145746 | A1 | 6/2007 | Biamonte |
| 2007/0153537 | A1 | 7/2007 | Scott et al. |
| 2007/0159810 | A1 | 7/2007 | Kim |
| 2007/0159823 | A1 | 7/2007 | Ho et al. |
| 2007/0171628 | A1 | 7/2007 | Seade |
| 2007/0189003 | A1 | 8/2007 | Daley |
| 2007/0206373 | A1 | 9/2007 | Whiteside et al. |
| 2007/0236915 | A1 | 10/2007 | Chen |
| 2007/0236916 | A1 | 10/2007 | Hsu |
| 2008/0130272 | A1 | 6/2008 | Waters |
| 2008/0263750 | A1 | 10/2008 | Chen et al. |
| 2008/0266839 | A1 | 10/2008 | Claypool et al. |
| 2009/0147503 | A1 | 6/2009 | Bennett |
| 2009/0148149 | A1 | 6/2009 | Chishima |
| 2009/0193566 | A1 | 8/2009 | Waters |
| 2010/0214767 | A1 | 8/2010 | Waters |
| 2010/0307931 | A1 | 12/2010 | Waters |
| 2010/0313335 | A1 | 12/2010 | Waters |
| 2011/0122601 | A1 | 5/2011 | Waters |

FOREIGN PATENT DOCUMENTS

| | | | |
|---|---|---|---|
| AU | 63109/94 | | 11/1994 |
| AU | 199940150 | | 2/2000 |
| AU | 199959545 | | 3/2000 |
| AU | 2002100976 | | 6/2003 |
| AU | 2003100277 | | 7/2003 |
| AU | 2003248016 | | 11/2004 |
| CA | 2029772 | | 5/1991 |
| CA | 2198625 | | 2/1997 |
| CA | 2184336 | | 5/1997 |
| CA | 2406450 | | 11/2001 |
| CA | 2466175 | | 5/2003 |
| CN | 86208973 | | 10/1987 |
| CN | 2173427 | | 8/1994 |
| CN | 2239167 | | 11/1996 |
| CN | 2423761 | | 3/2001 |
| CN | 2433836 | | 6/2001 |
| CN | 2458892 | | 11/2001 |
| CN | 2508592 | | 9/2002 |
| CN | 2544551 | | 4/2003 |
| CN | 1462597 | | 12/2003 |
| CN | 1603677 | | 4/2005 |
| DE | 8230583 | | 9/1983 |
| DE | 29808222 | | 11/1998 |
| DE | 19837151 | | 4/2000 |
| DE | 20007738 | | 9/2000 |
| DE | 29915607 | | 9/2000 |
| DE | 20017922 | | 2/2001 |
| DE | 20020515 | | 8/2001 |
| DE | 20101380 | | 8/2001 |
| DE | 20106261 | | 9/2001 |
| DE | 20111815 | | 11/2001 |
| DE | 10046295 | | 3/2002 |
| DE | 20117740 | | 4/2002 |
| DE | 20201557 | | 5/2002 |
| DE | 20200058 | | 6/2002 |
| DE | 10103591 | | 8/2002 |
| DE | 20110124 | | 8/2002 |
| DE | 10057388 | | 9/2002 |
| DE | 20209115 | | 10/2002 |
| DE | 20210806 | | 10/2002 |
| DE | 10216152 | | 12/2002 |
| DE | 20209611 | | 1/2003 |
| DE | 20313629 | | 12/2003 |
| DE | 10330589 | | 1/2004 |
| DE | 20319297 | | 2/2004 |
| DE | 20318860 | | 4/2004 |
| DE | 20318949 | | 4/2004 |
| DE | 202004004960 | | 9/2005 |
| EP | 1072204 | | 1/2001 |
| EP | 1374707 | | 1/2004 |
| FR | 1221782 | | 6/1960 |
| FR | 2798721 | | 3/2001 |
| FR | 2824709 | | 11/2002 |
| FR | 2829365 | | 3/2003 |
| FR | 2833068 | | 6/2003 |
| FR | 2833069 | | 6/2003 |
| GB | 2268043 | | 1/1994 |
| GB | 2316293 | | 2/1998 |
| GB | 2358575 | | 8/2001 |
| GB | 2363314 | | 12/2001 |
| GB | 2374401 | | 10/2002 |
| GB | 2378117 | | 2/2003 |
| GB | 2378118 | | 2/2003 |
| GB | 2388298 | | 11/2003 |
| JP | S 61-006304 | | 1/1986 |
| JP | 4289602 | | 10/1992 |
| JP | H08-027610 | A | 1/1996 |
| JP | H09-209210 | A | 8/1997 |
| JP | H09-296319 | A | 11/1997 |
| JP | H10-331019 | A | 12/1998 |
| JP | 3084061 | | 11/2001 |
| JP | 2004-207580 | | 7/2004 |
| KR | 20-0164075 | | 2/2000 |
| KR | 200168826 | | 2/2000 |
| KR | 200260980 | | 1/2002 |
| KR | 20020065405 | | 8/2002 |
| KR | 200331201 | | 10/2003 |
| TW | 241462 | | 2/1995 |
| TW | 275188 | | 5/1996 |
| TW | 286489 | | 9/1996 |
| TW | 324234 | | 1/1998 |
| TW | 329607 | | 4/1998 |
| TW | 386364 | | 4/2000 |
| WO | 94/02043 | | 2/1994 |
| WO | 97/04434 | | 2/1997 |
| WO | 02/44611 | | 6/2002 |
| WO | 02/062165 | | 8/2002 |
| WO | 02/074398 | | 9/2002 |
| WO | 02/077520 | | 10/2002 |
| WO | 03/040808 | | 5/2003 |
| WO | 03/047377 | | 6/2003 |
| WO | 03/083811 | | 10/2003 |
| WO | 04/000054 | | 12/2003 |
| WO | 2004/064555 | | 5/2004 |
| WO | 2004/103104 | | 12/2004 |
| WO | 2005/002378 | | 1/2005 |
| WO | 2005/005882 | | 1/2005 |
| WO | 2005/038337 | | 4/2005 |
| WO | 2005/096856 | | 10/2005 |
| WO | 2005/098314 | | 10/2005 |
| WO | 2006/037845 | | 4/2006 |
| WO | 2006/124928 | | 11/2006 |
| WO | 2007/073047 | | 6/2007 |
| WO | 2007/073219 | | 6/2007 |
| WO | 2007/089236 | | 8/2007 |
| WO | 2007/093348 | | 8/2007 |
| WO | 2007/112338 | | 10/2007 |
| WO | 2008/011750 | | 1/2008 |
| WO | 2009/079656 | | 6/2009 |
| WO | 2010/099504 | | 9/2010 |

OTHER PUBLICATIONS

"Complaint", *Waters Industries, Inc.* v. *Totes Isotoner Corporation*, et al., United States District Court for the Northern District Of Illinois, Case No. 1:10-cv-04487.

Written Opinion of the International Searching Authority and International Search Report from the International Bureau of WIPO for International Application No. PCT/US2006/018968, dated Oct. 16, 2006, 12 pages.

Notification of Transmittal of the International Search Report and the Written Opinion of the International Searching Authority, or the Declaration from the International Bureau of WIPO for International Application No. PCT/US2008/087542 dated May 4, 2009, 12 pages.

Notification of Transmittal of the International Search Report and the Written Opinion of the International Searching Authority, or the Declaration from the International Bureau of WIPO for International Application No. PCT/US2010/025689 dated May 4, 2010, 14 pages.
Notification of Transmittal of the International Search Report and the Written Opinion of the International Searching Authority, or the Declaration from the International Bureau of WIPO for International Application No. PCT/US2011/034686 dated Aug. 1, 2011, 16 pages.
Notification of Transmittal of the International Search Report and the Written Opinion of the International Searching Authority, or the Declaration from the International Bureau of WIPO for related International Application No. PCT/US2011/034695 dated Oct. 28, 2011, 12 pages.

* cited by examiner

HEADWEAR WITH SWITCH SHIELDING PORTION

CROSS-REFERENCE TO RELATED APPLICATIONS

This application is a divisional of prior U.S. application Ser. No. 12/363,130, filed Jan. 30, 2009, which is a continuation of International Application Number PCT/US08/87542, filed Dec. 18, 2008, which claims benefit of U.S. Provisional Application No. 61/014,726, filed Dec. 18, 2007, which are hereby incorporated herein by reference in their entirety.

FIELD OF THE INVENTION

The field relates to hands-free lighting devices and, in particular, to lighted hats and protective guarding that may be mounted to the hat for protection against unintended activation of the lighting device.

BACKGROUND OF THE INVENTION

Often an individual desires a light focused to illuminate an area while performing a task or a light directed in a general outward direction for visibility. Holding a flashlight is an option, but such lighting devices are often cumbersome and may detract from the task being completed because the flashlight needs to be hand-held to be able to direct the light at a work site where the user needs illumination. As a result, hands-free lighting is often used because the individual desiring illumination does not need to hold the light source.

Lighted headgear may include illumination sources mounted to various types of headgear and hats. The light can be directed in such a manner so that the wearer is illuminated to be seen by others or directed downward to provide light forwardly of the wearer illuminating an area in the wearer's field of view, such as for reading. Applicant's U.S. Pat. No. 6,659,618 provides examples of such lighted hats. The light source can be one or more LEDs. Such LED lighted headgear, which may include LEDs mounted to a typical baseball-style cap, are convenient for hands-free lighting in a number of recreational activities, such as camping, hunting, fishing, jogging, or the like. Lighted headgear may include separate components such as one housing or assembly to hold a power source and other electrical components and a separate housing or assembly to contain the illumination source. Other lighted hats may contain all electrical components within a crown and/or brim portion of the hat. In each case, the lighted headgear generally includes a user-activated power switch (to energize the light source) positioned on one of the housings or on a portion of the hat.

In many cases, the lighted headgear is displayed on a store shelf in a manner so that a potential purchaser can operate the switch to turn on the light source. To this end, the hat may be provided to the store with a power source already included so that the light source can be activated by the consumer. However, because the lighted headgear may be shipped in bulk to the store with the power source included, the power source can be unintentionally activated through contact of the activation switch with an adjacently packed hat. In particular, where the activation switch is positioned on the hat brim, the light source can be inadvertently turned on during the shipping process by the hat brim of one hat engaging or depressing the activation switch of another hat nested therewith. Such inadvertent activation can drain the power source prior to the hat's display on the store shelf.

Prior packaging arrangements have been configured to allow actuation of a switch to momentarily activate a power source while an item is encased with the packaging, but such prior packaging is generally a blister-type pack that completely encases the product so that it tends to be bulky and distracts from the appearance of the item within the package. Moreover, such prior blister-pack arrangements generally do not include sufficient structure on the packaging to block inadvertent actuation of the switch that might cause power to drain from the battery. Therefore, when these prior packaging designs are shipped in bulk, there is the risk that engagement between adjacent packages could energize the power source and drain the battery.

For example, U.S. Pat. No. 6,311,837 to Blaustein provides a bulky blister pak for an electric toothbrush that allows momentary activation of the toothbrush while within the packaging material by permitting a power switch to be depressed momentarily, but attempts to block continuous actuation of the power source by hindering the sliding of the switch to a permanently on position. To this end, Blaustein permits the momentary depressing of its power switch by relying on the flexibility of the blister pak material covering the switch that can easily deform to allow the switch to be depressed, but then includes a single and narrow rib adjacent one side of the momentary switch to prevent the sliding action of the switch to the continuously on position.

Blaustein's single rib is designed primarily to block the activation switch from shifting or sliding in a direction along the shaft of the toothbrush to prevent the switch from being shifted to the continuous on position. Although this packaging arrangement may be effective to prevent the switch from being slid to the continuously on-position, the blister pak has a relatively flexible material surrounding the switch in order to permit the momentary actuation of the switch. Therefore, inadvertent actuation may still occur when multiple items having this packaging arrangement are stacked atop one another. When sufficient items are tightly packed in a box or other shipping crate, a force between packed items may be sufficient to deform of the thin blister pak material covering the switch to depress the switch to the momentary on position. Therefore, Blaustein's switch can be inadvertently depressed to the momentary on position and the power source drained.

Lighted headgear may include activation switches that are operable to establish electrical communication between the power source and the illumination source. The illumination source can be energized once the activation switch is depressed, slid, or otherwise shifted to an on position. For example, it is known to place a push button switch underneath the fabric covering the rigid brim material. However, many activation switches tend to be large and bulky and they do not allow the hat to maintain its normal more desired appearance because the switch provides bulges or other bumps in the profile of the hat.

SUMMARY OF THE INVENTION

There is provided lighted headgear with a removable brim sleeve that may be mounted to a brim portion of the lighted headgear so as to provide protection against inadvertent actuation of a light switch associated with the lighted headgear. Preferably, the brim sleeve will include a thin cardboard, paperboard, or other fiberboard packaging cover or body capable of being detachably mounted to a brim of the lighted headgear. An upper portion of the brim sleeve body is configured to extend across and substantially cover a top portion of the lighted hat brim and is connected to at least one lower portion of the brim sleeve body, which is configured to extend along a bottom surface of the lighted hat brim between opposite brim side edges thereof. Such a configuration provides a packaging cover that forms a sleeve about the brim that generally conforms to the upper and lower brim surfaces so as to maintain a thin profile having a curvature similar to that of the brim surfaces. This configuration of the brim sleeve provides a packaging surface for indicia or other cap identification, but is not bulky and generally does not distract from the hat's appearance because it configured to conform to the curvature of the upper and lower brim surfaces. In addition, such compact and conforming configuration of the brim sleeve relative to the hat brim also enables a consumer to try on the hat in the store because the brim sleeve does not interfere with the crown or other head wrapping portion of the hat.

The lighted headgear also includes an actuation switch used to actuate the light source on the lighted headgear. The actuation switch may include a variety of forms and be positioned in a variety of locations on the hat. In one example, the actuation switch is disposed on the lower brim surface and has a button or plunger actuator extending away from the brim surface that is configured to be depressable toward the brim such that the light source may be actuated to an "on" or "off" state by depressing the button or plunger actuator towards the brim. A user may depress the button or plunger actuator to actuate the lighted headgear to its on-state, which may include a number of alternative lighting modes (blinking, colors, varying number of light sources energized, etc.) selected by repeatedly depressing the button to select the modes of the on-state. The light source will remain in the on-state (or selected lighting mode) until the user again depresses the plunger actuator causing the switch to configure the lighted headgear to an off-state.

The brim sleeve may also include a protection or switch guard adjacent to or extending around the actuation switch. For example, at least one lower portion of the brim sleeve body may have the switch guard associated therewith that is configured to extend about the actuation switch so as to avoid inadvertent actuation thereof. The switch guard may be a portion of the cardboard body or be a separate plastic piece mounted to the cardboard or paperboard portion of the brim sleeve via a mounting flange and a mating surface. In a preferred form, the switch guard is a molded plastic material having an upstanding flange or wall portion that, when mounted to the hat brim, extends away from the brim surface beyond the plunger actuator to serve as a barrier for avoiding unintentional actuation of the actuation switch. The upstanding flange or wall portion may generally encircle the activation switch, but still has an access opening associated with the button or plunger actuator thereby providing direct and intentional access to the switch.

Many lighted hats may be manufactured at the same facility and transported from the facility to a retail store for consumer purchasing in a shipping box or other crate. A convenient way to transport such lighted hats is to place a plurality of lighted hats in a nested configuration where the individual hats within the plurality of lighted hats stack atop one another such that a crown of a lower lighted hat is inserted into a crown of an upper lighted hat while a brim of the lower lighted hat overlaps at least a portion of a brim of the upper lighted hat. This nested configuration allows for convenient and efficient transportation of the plurality of lighted hats. In order to prevent inadvertent actuation of an activation switch associated with any of the individual hats within the plurality of lighted hats, an insert spacer device is provided that is positioned between the nested brims of adjacent hats. For example, the insert spacer device may be positioned between the brim upper surface of the lower hat and the brim lower surface of the upper hat. The spacer device is then arranged and configured to maintain a space between the two hat brims so that the switch on the lower surface of the upper hat remains spaced from the upper brim surface of the lower hat when the hats are in a nested arrangement.

In one form, the insert spacer device may include the above described brim sleeve and switch guard to prevent the inadvertent actuation of the corresponding activation switches associated with each of the individual hats when in the nested arrangement. In particular, each hat will include an associated brim sleeve surrounding its brim with the associated switch guard extending about its activation switch. These switch guards will also preferably have an upstanding flange or wall portion that encircles the activation switch to avoid inadvertent actuation of the activation switch by any of the other individual hats within the plurality of lighted hats in the nested configuration.

DETAILED DESCRIPTION OF THE PREFERRED EMBODIMENT

Figure 1:
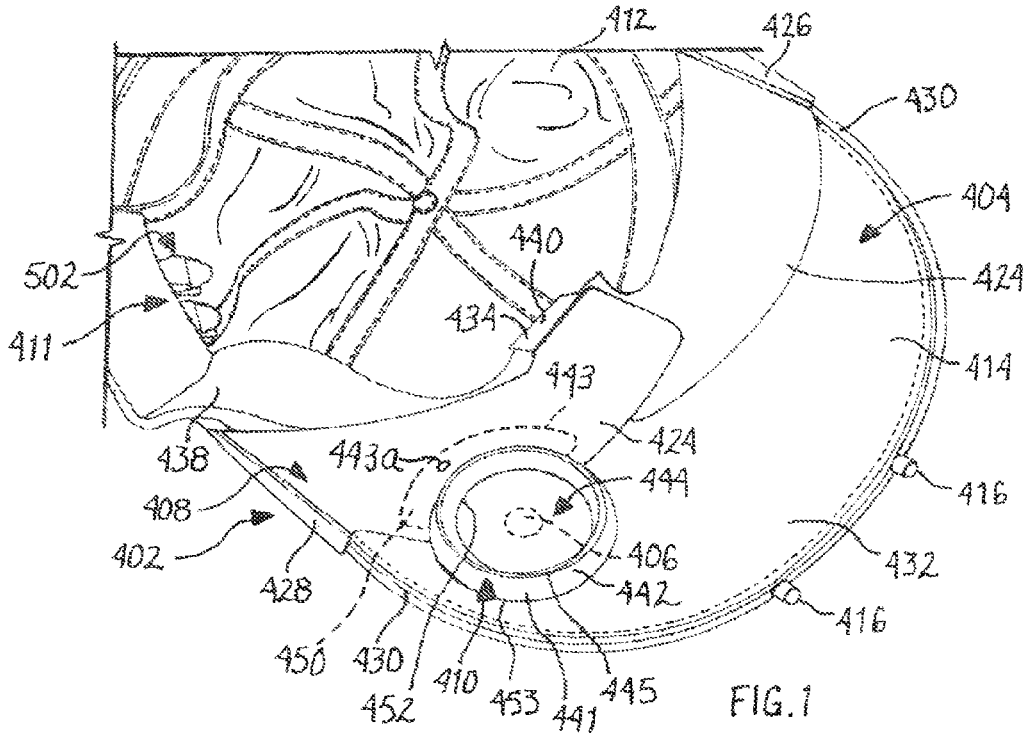
FIG. 1 is a bottom plan view of a lighted baseball hat showing packaging material that includes a protective guard for an activation switch.

In general, the various aspects of the disclosure herein relate to hands-free lighting, components thereof, and other accessories therefor combined with the hands-free lighting. As further described below, the hands-free lighting may include lighted headgear such as hats, including baseball caps, hoods, and other lighted clothing items having the lights positioned thereon to provide lighting forwardly of the wearer. A hands-free lighting accessory associated with the lighted headgear is removable packaging materials with a protective guard that limits inadvertent actuation of a switch to energize the lights of the lighted headgear. The packaging materials may be configured to conform to the lighted headgear in a streamlined manner.

Referring to FIGS. 1-5, a guarding or covering device 402 preferably in the form of a brim sleeve is illustrated for use in combination with a lighted hat 404 for providing a packaging cover for the hat and for providing a barrier to hinder or prevent inadvertent activation of a power switch 406 on the lighted hat 404. The brim sleeve 402 is advantageous because it provides both a packaging cover for the hat to provide information about the hat and, at the same time, protects against unintended power source activation, which enables a power source or other battery to be installed in the hat during manufacture so that the hat can be shipped to a retail store without the risk of the installed power source being inadvertently drained.

In general, the brim sleeve 402 is provided with a detachable covering 408, which is detachably securable to the hat 404, and a barrier wall or shielding member/portion 410 for protection against accidental actuation of the switch 406. The shield portion 410 protects the switch 406 from unintended actuation but, at the same time, still permits direct and intentional actuation of the switch 406 by a potential purchaser or other user. That is, the shield member 410 is configured as a protective barrier that is adjacent to and, preferably partially or completely surrounding the switch 406 so that an adjacent surface (such as a table, wall, or other nested hat 404*a* shown in FIG. 3) will not cause the switch 406 to be inadvertently depressed because the shield 410 keeps the adjacent surface spaced a predetermined distance from the switch 406 and, thus, restricts the adjacent surface from contacting the activation switch 406. At the same time, the shield member 410 also has an access opening sized to provide direct and intentional access to the switch 406 by the user for intentional actuation. In this manner, the hat 404 can be shipped to a store having a power source 411 installed without the risk of the unintentional activation of the power switch when the hat is contacted by an adjacent surface (such as with multiple hats nested together) that could drain the battery prior to the store shelf. At the same time, the shielding member 410 also permits the activation switch 406 to be intentionally activated through the access opening to allow a consumer to test the hat while it is on the store's display shelf.

Figure 4:
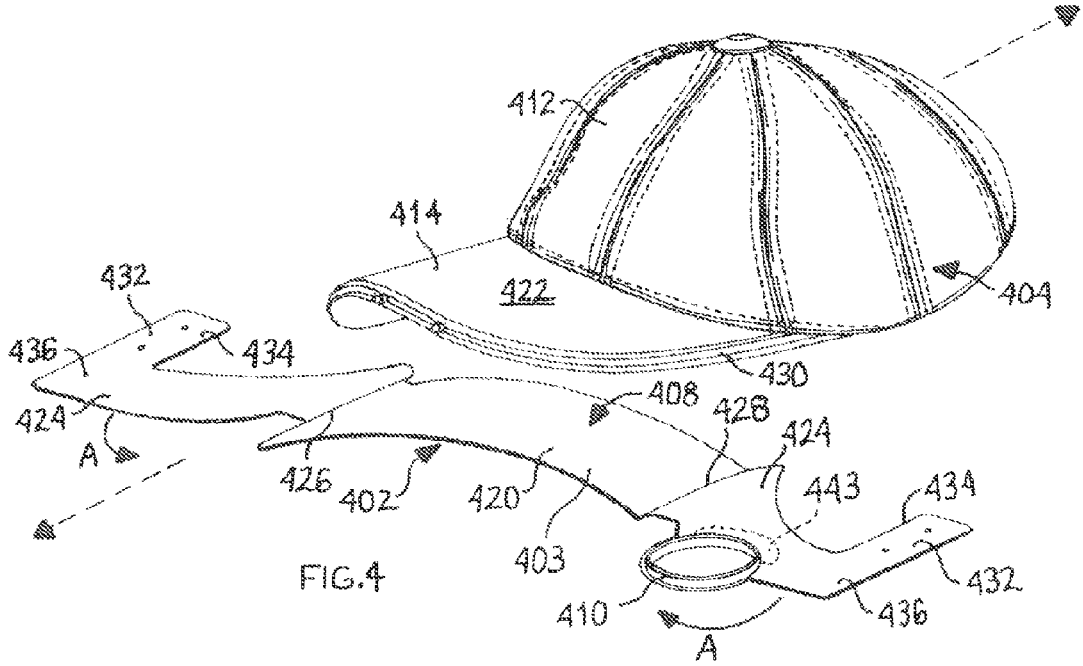
FIG. 4 is a perspective view of the lighted baseball hat showing the packaging material including the protective guard in an unwrapped configuration.
Figure 5:
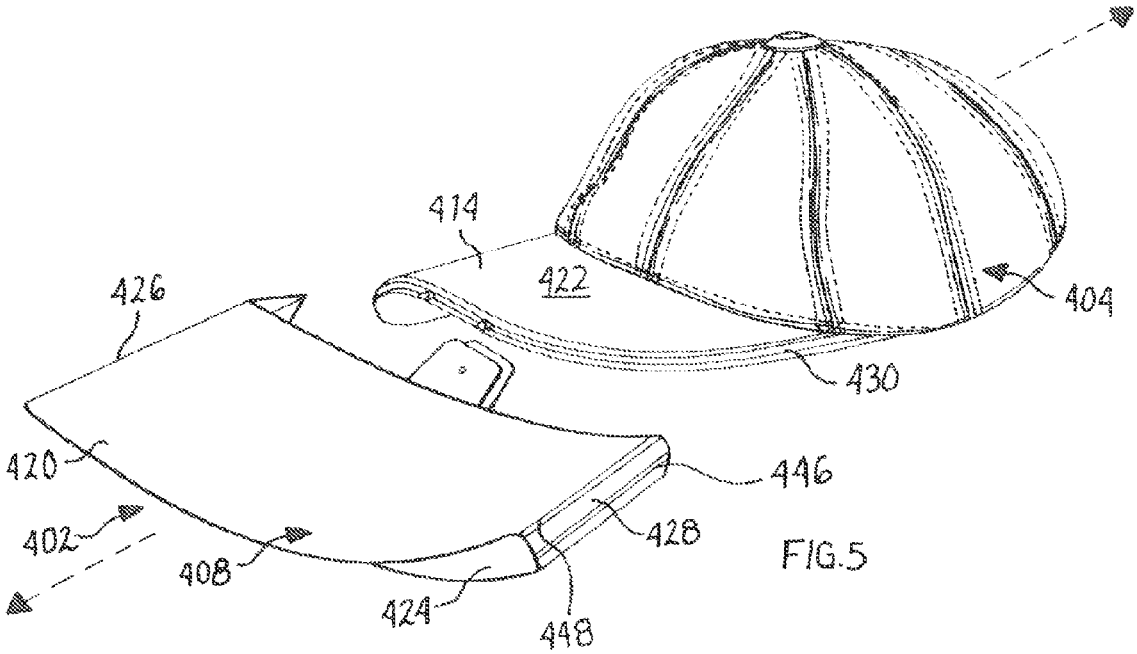
FIG. 5 is a perspective view of the lighted baseball hat showing the packaging material including the protective guard in a wrapped, sleeve configuration.

As shown in the drawings, the hat 404 may be a traditional baseball style hat having a crown portion 412 and a brim portion 414 extending from a forward, lower edge of the crown portion 412 as shown in FIGS. 1, 4, and 5. The hat 404 also preferably includes one or more illumination sources 416, which can be any of the previously described light sources herein or described in related U.S. application Ser. No. 11/941,558, which is incorporated herein in its entirety. While the guarding device 402 is particularly useful in a configuration designed for the baseball-style hat, it will be appreciated that the guarding device 402 may also be configured for other types of headgear in a similar fashion. In addition, while the shielding member/portion 410 of the guarding device 402 is preferably intended to avoid unintended activation of the illumination sources 416, the shielding member 410 may also be used to prevent inadvertent actuation of other switches configured to operate additional accessories mounted to headgear, such as cameras, speakers, radios, MP3 players to suggest a few examples.

Figure 3:
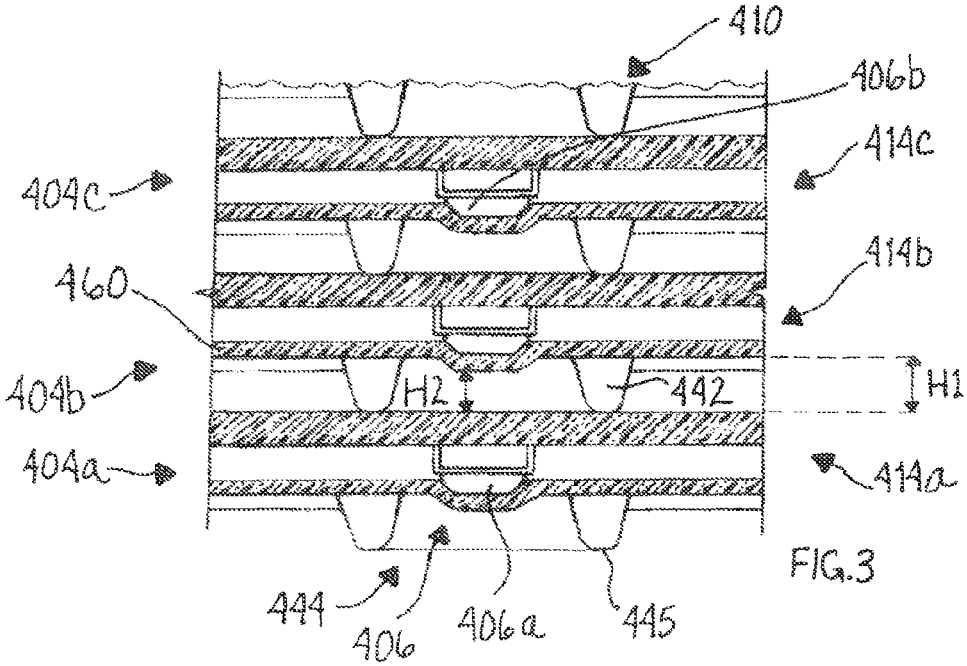
FIG. 3 is a cross-sectional view of the brims of a plurality of nested hats showing the protective guards keeping the adjacent brims spaced to avoid accidentally actuating the brim switches.

In one form, the shielding member/portion 410 of the guarding device may be particularly effective in preventing the inadvertent actuation of an illumination activation switch 406 having a depressable button or plunger actuator 406*a* for actuating the illumination source as generally shown in FIG. 3. The plunger actuator 406*a* of the switch 406 includes an outer button 406*b* that extends away from the brim and is depressable towards the brim to energize the light source on the lighted hat between an "on" or "off" state. To this end, if the button is depressed a first time, the light on the lighted hat is energized to its "on" state where the light will remain continuously in the on-state until the user again depresses the button or plunger a second time causing the switch to configure the lighted hat to its "off" state. As described more below, the shield member/portion 410 effectively prevents inadvertent actuation of the lighted hat by surrounding the activation switch and plunger thereof and extends farther beyond the surface of the hat than the plunger actuator. This additional distance the shield extends past the plunger is effective at preventing inadvertent depressing of the button or plunger actuator because the shield blocks or hinders access to the plunger actuator.

Turning to more of the details, the detachable covering 408 of the guarding device 402 effectively forms a sleeve that encircles the hat brim and includes a thin cardboard or paperboard body 403 (FIG. 4) having a top or major surface portion 420 configured to conform to an upper curvature of a top surface 422 of the hat brim 414 and is sized to extend across the top surface 422 of the brim 414 (FIG. 4). The brim sleeve body 403 also includes a pair of flap arms or side portions 424 extending from opposite side ends 426 and 428 of the body top portion 420. The flap arms or side portions 424 are configured so as to fold under the top portion 420 as generally illustrated in FIGS. 1 and 5 (see Arrows A in FIG. 4). Preferably, the flaps 424 have a length sufficient so that they overlap each other when in the folded configuration under the hat brim as best shown in FIG. 1. In this manner, when mounted to the hat 404, the brim sleeve top portion 420 extends across the upper surface 422 of the hat brim 414, and the brim sleeve arm side portions 426 are configured to fold under the brim 414 at the brim edge 430 and extend across a lower surface 432 of the hat brim 414 as best shown in FIG. 1. To this end, the packaging cover body 408 may include various folds, creases, or bends as needed to permit the arm flaps 242 to easily bend or fold around the brim edges 430.

The opposite side ends 426 and 428 of the brim sleeve are generally of the same thickness as the hat brim 414 (FIG. 5) and connect/extend between the brim sleeve top portion 420 and the flap arms or side portions 424 such that the detachable covering 408 may maintain a profile similar to the hat brim 414 when mounted thereto. To this end, the opposite side ends 426 and 428 each may have a lower edge 446 and an upper edge 448 (FIG. 5), which connect between the side portion 424 and the top portion 420, respectively. Both the lower edge 446 and the upper edge 448 may contain score lines, folds, creases, perforations or other indents therealong that facilitate bending of the cardboard or paperboard material of the brim sleeve body 403, which allow the opposite side ends 426 and 428 to maintain a similar profile and thickness as the brim edge 430.

Each of the flaps 424 permits the covering 408 to be detachably mounted to the hat 404. By one approach, each flap 424 also includes a fastening member 440 in the form of a rearwardly extending strip 434 located adjacent the distal ends 436 of the flaps 424 (FIG. 1 and FIG. 4). As best shown in FIG. 1, each of the strips 434 are configured to overlap each other and be wrapped or folded into a headband material 438 formed within the hat crown 412. The strips 434 are either inserted in the headband and/or fastened thereto via a fastener 440, such as a staple, pin, snap, strap, adhesive and the like extending through both strips 434 and the fabric material forming the headband. By overlapping the strips 434 and fastening them to the headband 438, the guarding device 402 can be removably mounted to the brim 414 because the guarding device 402 can be removed from the hat simply by removing the fastener 440 and unfolding the strips 434 and flaps 424 from around the brim 414. In this manner, the covering 408 and guarding device 402 thereof can be secured to the hat 404 without detracting from the hat's appearance by forming a sleeve encasing the hat's brim only. To this end, by securing the covering 408 to the hat as provided herein, the hat can be tried on by a consumer in the store because the brim sleeve 402 conforms to the hat's profile and does not hinder or block the hat's crown portion 412.

The body 403 of the brim sleeve 402 is preferably a paper, cardboard, fiberboard, laminate or other conformable packaging-type material that is sufficiently flexible and can be folded at the ends 426 and 428 rending it capable of conforming to the curvature of the hat brim 414. To this end, the covering 408 may include score lines, folds, creases, perforations or other indents 448, 446 to permit easier folding and to define intersections between the adjacent cover sections. The top surface 420 of the detachable covering 408 may also include a decorative outer layer to be used for various markings and other indicia such as labels, logos, and other instructions so that the brim sleeve 402 also functions as a product identifier or marketing label. For instance, the top surface may indicate that the light source may be tested by suggesting the hat includes a "try me feature".

The shield member or portion 410 of the brim sleeve may be a portion of the paperboard body or, preferably, include a separate structure formed from a molded plastic that is attached to a portion of the paperboard body 403 of the brim sleeve. By one approach, the shield member 410 includes a wall 442 formed from upstanding flanges 441 (FIGS. 1 and 2) that can be positioned adjacent to and, preferably, partially or completely surround the hat switch 406. At the some time, the upstanding flanges 441 of the wall 442 also form a switch access opening 444 on a distal end 445 of the wall 442 to provide an opening for direct and intentional access to the switch 406 as generally illustrated in FIGS. 1 and 3. To this end, the plunger actuator 406*a* of the switch 406 is not covered by either the material forming the body 403 of the brim sleeve 402 or the plastic of the shield member 410, but still has the upstanding flange 441 of the wall 442 adjacent thereto to act as a barrier to prevent inadvertent actuation of the switch 406. Preferably, the shield 410 is formed from a plastic material and molded into the preferred annular shape. However, while the shield 410 is illustrated in the drawings as having an annular configuration, it will be appreciated that the guard 410 may be any shape so that as it is adjacent to and/or surrounds the switch and is capable of preventing unintended activation of the switch.

In one form, the shield wall 442 is formed from the upstanding flanges 441 and, in particular, a pair of upstanding flanges that form an annular structure arranged and configured to encircle the switch 406 when mounted to the hat. Turning again to FIG. 2, the wall 442 includes the pair of upstanding wall flanges 454 and 456 generally extending toward each other to form a tapered wall configuration where the base of the wall 442 has a wider width than a distal end of the wall. The tapered configuration includes an outer wall flange 454 and an inner wall flange 456 that are on either side of the access opening 114 of the shielding member 410. This tapered configuration is advantageous because it provides enhanced strength to the shield wall 442.

When the shield 410 is a separate piece from the paperboard body of the detachable covering 408, it also includes a mounting flange 443 thereof so that it can be mounted by a fastener 443*a* (such as staples, pins, adhesive, and the like) to a corresponding mating surface 450 located on one of the brim sleeve body flaps 424 in a position so that when the body 403 is mounted to the brim 414 as described above, the wall 442 of the shield member 410 surrounds the brim mounted switch 406 as best illustrated in FIG. 1. To this end, the mounting flange 443 preferably extends generally orthogonal or approximately transverse to the wall 442 and extends from one side of the shield 410 as best shown in FIG. 1. This permits the shield 410 to extend away from one edge of the brim sleeve flap arms 424.

Figure 2:
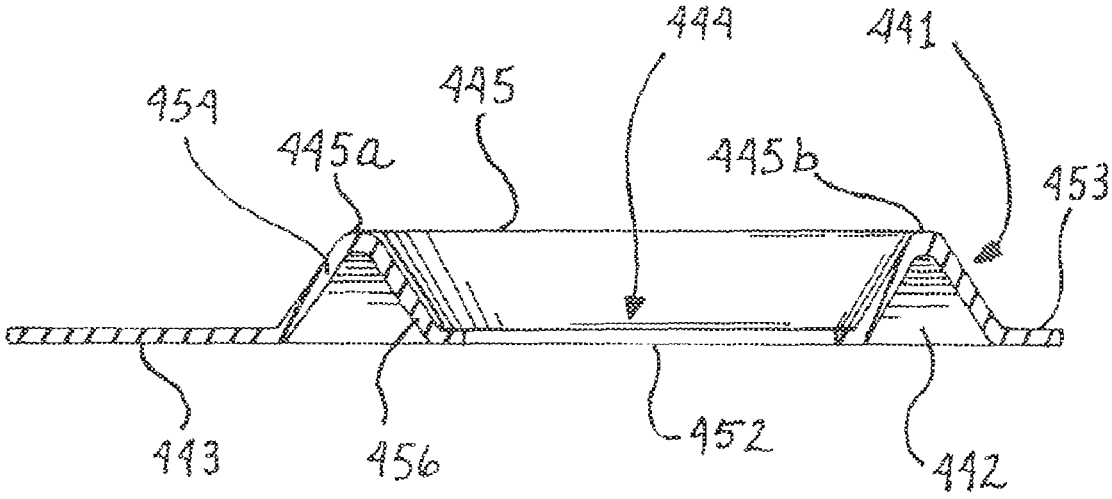
FIG. 2 is a cross-sectional view of a wall portion of the protective guard of the packaging material having an inner and outer flange portion configured to prevent inadvertent actuation of the activation switch.

The shield member 410 also preferably includes seating flanges for providing a flush engagement with the brim surface when mounted thereto. Turning to FIG. 2, the shield member 410 includes an outer seating flange 453 adjacent the outer wall flange 454 and an inner seating flange 452 adjacent the inner wall flange 456. Each seating flange 453 and 452 is configured to sit flush with the brim surface so that the shielding member 410 can be mounted flush to the brim when the brim sleeve is secured thereto. More particularly, the outer seating flange 453 generally extends outwardly away from wall flange 454 and the inner seating flange 452 extends inwardly to the access opening 444 adjacent the inner flange wall 456.

Still referring to FIG. 2, the inner and outer seating flanges 453 and 452 are spaced apart from one another at the base of the wall 442, which help provide enhanced stability of the shield member 410 while attached to the lighted hat 404 so as to keep the shielding device adjacent to and/or surrounding the hat switch 406. The inner seated flange 452 is connected to the inner vertical flange 456 and extends annularly and in a generally parallel direction to the hat brim 414 about an inner, lower edge of the access opening adjacent the hat brim. The inner seated flange 452 may rest generally flush against the lower surface of the hat brim 414 and generally encircle the activation switch 406. The outer seated flange 453 is connected to the outer vertical flange 454 and extends annularly and in a generally parallel direction to the hat brim 414. The outer seated flange 453 may also rest generally flush against the lower surface of the hat brim 414. Moreover, at least a portion of the outer seated flange 453 may be connected to the mounting flange 443 to connect the shield member 410 to the detachable covering 408.

The preferred annular shape of the shielding member 410 and upstanding flange 441 having the distal end 445 thereof spaced beyond the switch prevent inadvertent actuation of the activation switch 406 by providing barrier wall that surrounds the switch 406 and provides an blocking surface at multiple contact locations along the annular distal end 445 against an intruding object. For example, an object having a size larger than the access opening 444 and coming in contact with the shield member/portion 410 may contact various locations along the annular distal end 445 at the same time. In one form, the intruding object may contact two opposite locations (i.e., 445*a* and 445*b* in FIG. 2) on opposite sides of the annular distal end 445 allowing the distal end 445 to support the intruding object at the two opposite locations above the activation switch 406 thereby preventing inadvertent activation of the switch 406 by the intruding object. By providing at least two points of contact, the wall 442 provides enhanced resistance from being crushed or deformed upon engaging a surface.

The guarding device 402 is advantageous because it keeps adjacent surfaces away from the power switch 406. One useful application is when a plurality of hats 404 are nested together for packaging and shipping to a store. Turning to FIG. 3, a plurality of lighted hats each having a crown 412 (not shown in FIG. 3) and a brim 414 are disposed in a nested configuration. In this example, this nested configuration includes a lower one of the lighted hats (414*a*) being nested together with an upper one of the lighted hats (404) such that the crown of the lower lighted hat is inserted into the crown of the upper light hat and the brim 414*a* of the lower lighted hat overlaps at least a portion of the brim 414 of the upper lighted hat (i.e., lower brim 414*a* overlays middle brim 414, which in turn overlays upper brim 414*b*), Each of the plurality of nested lighted hats has a spacer device in the form of the guarding device 402 mounted thereto to prevent inadvertent actuation of the activation switch 406 on each of the hat brims. As disclosed above, the guarding device 402 preferably includes the shield member 410, To provide guarding, the shield member wall 442 has a height HI thereof that is greater than a distance the switch 406 extends beyond a surface of the brim 414 so that the distal end 445 of the shield 410 is spaced a distance H2 from the switch 406. In this manner, the guard 410 and in particular the wall 442 thereof keeps the brim 414*a* of the adjacent, lower nested hat 404*a* spaced from the activation switch 406 of the middle hat brim 414 because the shield wall 442 keeps the adjacent, nested brim 414*a* from contacting the middle hat switch 406. The height HI of the guard wall 442 is also sufficiently high so that even if a fabric 432 covering the brim is pulled tight over the switch 406, the switch is still spaced from the top 445 of the guard wall 442.

Figure 6:
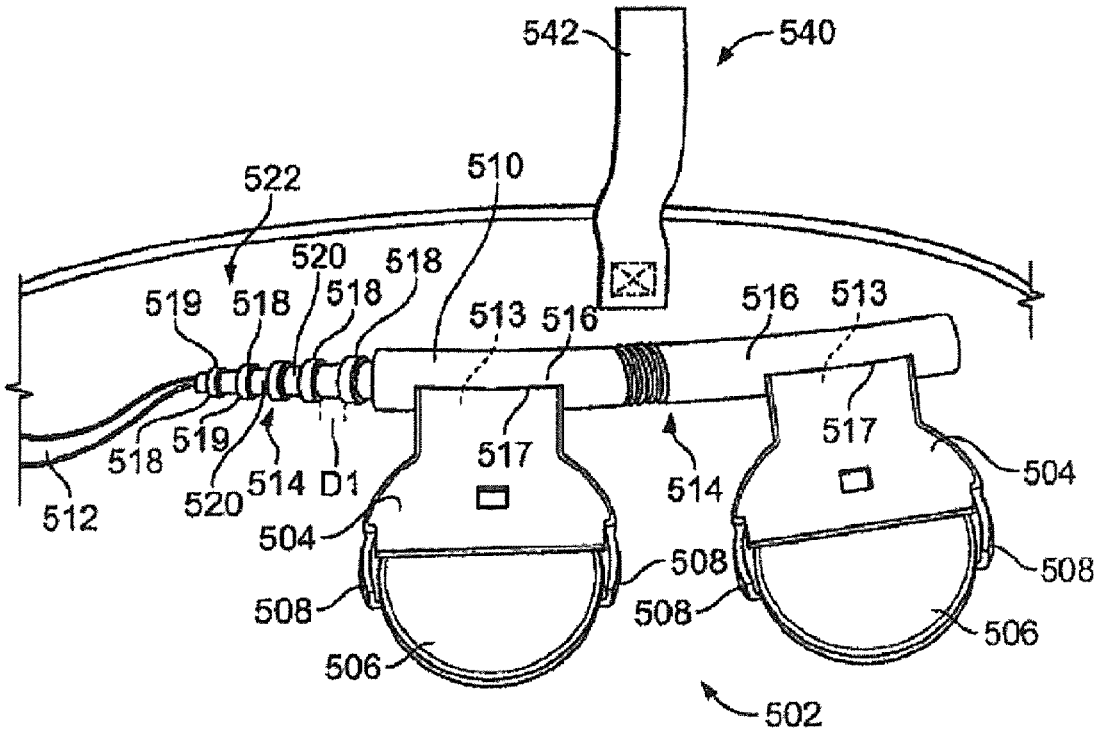
FIG. 6 is a perspective view of a battery holder configured to be attached to a lighted hat via a flexible strip and showing an elongate, resilient base member having a relatively flexible portion and a relatively rigid portion.
Figure 7:
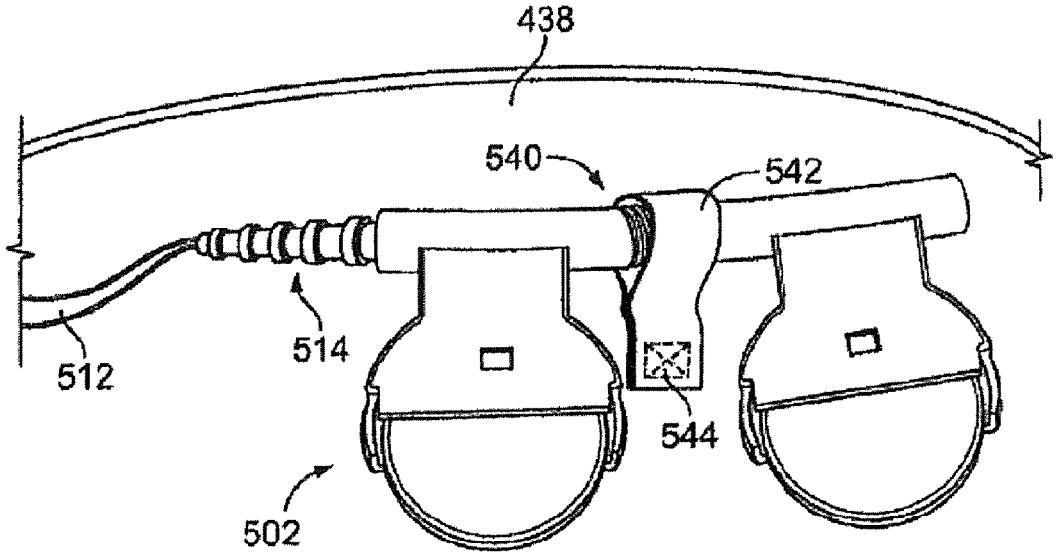
FIG. 7 is an elevational view of the battery holder showing the flexible strip fastening the base of the holder to the lighted hat.

Referring to FIGS. 1, 6, and 7, a flexible battery module 502 for use in the lighted headgear described herein is illustrated. As shown in FIG. 1, the battery module 502 is configured for insertion in the headband material 438 formed on the lower, inner portion of the hat crown 412. That is, on a typical baseball-style cap, the headband material 438 is folded inwardly to an interior space formed by the crown 412 to form a generally annular space between the headband 438 and the inner surface of the crown 412. The flexible battery module 502 is preferably inserted in this space and fastened to the hat band or crown. The module 502 is configured to be flexible to permit portions of the battery module 502 to flex and bend. In this regard, the module 502 may generally conform to the Curvature of the hat crown 412 and provide a more comfortable wearing experience for an individual because the battery module 502 is capable to better conform to the curvature of the wearer's head with fewer rigid portions that can create a protrusion that may abut into the wearer's head. At the same time, the module 502 also includes more rigid portions that are configured to protect a connection with the battery.

Turning to FIG. 6, one form of the module 502 is illustrated in more detail. As illustrated, the module 502 includes two battery receiving pockets 504, which are configured to each received a single battery 506, such as a thin, coin-cell type battery, in a generally snap-fit connection. For example, the battery 506 is preferably snapped into the pocket 504 by being snuggly received therein by spaced gripping fingers 508 on either side of the pocket 504. As described in more detail below, each pocket 504 is mounted to a base member 510 that encloses electrical wiring 512 and provides a rigid mounting portion for connection to the pockets 504 and also includes flexible bending portions for providing the ability of the module 502 to conform to the curvature of the hat.

The wiring 512 extends through the base to each of the batteries and out a distal end of the base where it can be connected to a circuit board, illumination source, switch, or other accessory (not shown). The base 510 provides rigid protection to an electrical connection 513 between the wires and each battery 506 that limits the amount of bending or flexing that can occur at this connection. While the module 502 is shown with two battery pockets 504, it will be appreciated that additional or fewer pockets may be included as needed to provide the desired power level to the hat and associated accessories.

In one form, the base 510 is an elongate tubular structure having an annular wall 512 forming a plastic tube through which the wiring 512 extends. The tube wall 512 includes multiple portions that include at least two relatively flexible portions 514 configured to permit the module 502 to bend or flex and also at least two relatively rigid portions 516 which form a rigid connection 517 to the battery pockets 504. The flexible portions 514 are formed from a series of annular bands 518 axially spaced along the length of the tubing with narrower tubing sections 520 in between the annular bands 518. The narrow tube sections 520 have a relatively thinner wall thickness compared to the rigid tube portions 516 and, therefore, permit the tubing portions 514 to flex or bend. The annular bands 518 have a relatively thicker wall dimension and can provide hard stops to limit the amount of bending of the flexible portions 514. To this end, as the portion 514 is flexed, upon sufficient bending, the outer edges 519 of the annular bands 518 will abut each other to limit the amount of bending. To control the amount of flexing of the tube, a spacing D1 between the annular bands 518 can be varied. For instance, greater spacing D1 will permit more bending of the flexible portion and narrower spacing D1 will permit less bending of the flexible portion.

Preferably, the base 510 includes two flexible portions 514. One flexible portion 514 is positioned between the two battery pockets 504 and rigid portions 516 to permit each battery pocket 504 to flex or bend relative to each other. The other flexible portion 514 is provided at the distal end 522 of the base 510 to provide flexibility at the location where the wiring enters the base 510.

Referring to FIG. 7, the module 502 is mounted to the headgear via a fastener 540. In one form, the fastener 540 is a loop of fabric material 542 that encircles the base 510 between each of the pockets 504 and is stitched 544 to the inside headband 438 of the hat. In this manner, the module 502 is conveniently attached to the hat, but permits ease of battery replacement because there is no other pocket, module, cover, or other material that needs to be unscrewed, removed, or opened in order to reach the battery. The user can unfold the headband 438 to access the batteries 506. While the fabric loop 542 is illustrated as one mounting method for the module 502, it will be appreciated that other type of mountings may be used to secure the module to the hat, such as but not limited to, snaps, Velcro, glue, fabric pockets, and other common fastening methods.

It will be understood that various changes in the details, materials, and arrangements of the parts and components that have been described and illustrated in order to explain the nature of the lighted hats and garments as claimed may be made by those skilled in the art within the principle and scope of the invention.

What is claimed is:

1. A lighted hat comprising:

a crown portion for fitting on a wearer's head;

a brim portion generally extending forwardly from the crown portion;

a light source mounted to the brim portion;

an actuator for activating the light source mounted to the brim portion; and a shielding portion mounted to the brim portion adjacent the actuator to minimize unintentional shifting of the actuator and activation of the light source.

2. The lighted hat of claim 1 wherein the shielding portion is configured to extend around the actuator.

3. The lighted hat of claim 1 wherein the shielding portion has an annular configuration and extends completely around the actuator.

4. The lighted hat of claim 1 wherein the shielding portion includes an opening that allows for access to the actuator for intentional shifting thereof.

5. The lighted hat of claim 1 wherein the actuator comprises a depressible switch, and the shielding portion comprises a generally annular wall extending about the switch.

6. The lighted hat of claim 5 wherein the annular wall has a distal end and extends away from the brim portion lower surface to the distal end thereof, and a switch access opening at the distal end of the annular wall through which the switch can be depressed for activating the light source.

7. The lighted hat of claim 1 wherein the brim portion includes a generally rigid brim member and fabric covering the brim member with the actuator being disposed between the fabric and the brim member.

8. The hat of claim 1 further comprising a power source mounted to the crown portion, and electrical connections extending between the power source, and the light source and the actuator mounted to the brim portion.

9. The hat of claim 8 wherein the power source comprises one or more coin cell batteries.

10. A lighted hat comprising:

a crown portion for fitting on a wearer's head;

a brim portion generally extending forwardly from the crown portion;

a light source mounted to the brim portion;

an actuator for activating the light source mounted to the brim portion; and a shielding portion mounted to the brim portion adjacent the actuator to minimize unintentional shifting of the actuator and activation of the light source; and wherein the brim portion has an upper surface that faces upwardly and a lower surface that faces downwardly when the crown portion is worn with the brim portion extending forwardly therefrom, the actuator is a depressible switch that projects downwardly from the brim portion lower surface, and the shielding portion includes a wall configured to at least partially surround the depressible switch.

11. The lighted hat of claim 10 wherein the shielding portion wall has an annular configuration to completely surround the depressible switch.

12. The lighted hat of claim 10 wherein the brim portion includes a generally rigid brim member and a fabric covering the brim member; and the actuator is mounted to the brim portion between the brim member and the fabric covering.

13. The lighted hat of claim 10 further comprising one or more batteries mounted to the crown portion for providing power to the light source.

14. A lighted hat comprising:

a crown portion for fitting on a wearer's head;

a brim portion including a generally rigid brim member and a fabric material covering the brim member, the brim portion generally extending forwardly from the crown portion;

a light source mounted to the brim portion;

a depressible switch actuator for activating the light source and mounted to the brim portion between the fabric and the brim member; and a shielding portion distinct from the fabric material covering the brim member and mounted to the brim portion adjacent the switch actuator to minimize unintentional shifting of the switch actuator and activation of the light source.

15. The lighted hat of claim 14 wherein the shielding portion comprises:

a generally annular wall extending about the switch actuator in spaced relation thereto to minimize unintentional shifting of the switch actuator and activation of the light source;

a distal end of the annular wall spaced from the brim portion lower surface; and a switch access opening at the distal end of the annular wall through which the switch actuator can be depressed for activating the light source.

16. The lighted hat of claim 15 wherein the distal end is spaced from the switch actuator.

17. The lighted hat of claim 14 further comprising a power source housing having one or more batteries received therein and being mounted to the crown portion.

18. The lighted hat of claim 17 further comprising electrical wiring coupling the batteries within the power source housing to the light source and the depressible switch actuator.

19. The lighted hat of claim 17 wherein the crown portion includes a lower, inner portion thereof configured as a headband, and the power source housing is mounted to the crown portion between the headband and an outer portion of the crown portion.

20. The lighted hat of claim 14 further comprising a power source housing having replaceable batteries received therein.

21. A hat comprising:

a crown portion for fitting on a wearer's head;

a brim portion extending forwardly from the crown portion and including a generally rigid brim member and flexible material covering the brim member;

an electronic device mounted to at least one of the crown portion and the brim portion;

a power source mounted to the crown portion and configured to provide power to the electronic device;

a switch mounted to the brim portion and configured to operate the electronic device; and a shielding portion mounted to the brim portion adjacent the switch to minimize unintentional shifting of the switch and activation of the electronic device.

22. The hat of claim 21 wherein the switch includes a depressible actuator having a proximal portion and an distal free end portion for being pushed by a user to shift the actuator for activating the electronic device, and the shielding portion comprises an annular switch guard wall extending away from the brim portion to encircle the switch actuator, wherein the switch guard wall includes a wall proximal portion laterally adjacent to the switch actuator proximal portion and a wall distal portion forming an access opening that allows for access to the switch actuator distal portion for intentional shifting thereof, wherein the switch guard wall extends between the wall proximal portion laterally adjacent to the switch actuator proximal portion and the wall distal portion laterally adjacent to the depressible switch actuator distal portion to act as a barrier to minimize inadvertent shifting of the depressible switch actuator.

23. The hat of claim 22 wherein the switch guard wall distal portion is completely spaced from the switch actuator.

24. The hat of claim 21 wherein the power source comprises one or more coin cell batteries.

25. The hat of claim 21 further comprising electrical wiring coupling the power source to the electronic device and the switch.

26. The hat of claim 21 wherein the crown portion includes a lower, inner portion thereof configured as a headband; and the power source is mounted to the crown portion between the headband and an outer portion of the crown portion.

27. The hat of claim 21 wherein the flexible material comprises a fabric material.

28. The hat of claim 21 wherein the switch is mounted to the brim portion between the brim member and the flexible material.

* * * * *